United States Patent [19]

Houle et al.

[11] Patent Number: 4,966,373

[45] Date of Patent: Oct. 30, 1990

[54] FLYING RING

[76] Inventors: Jean C. Houle; Lise Therrien, both of 890 St. Joseph Boulevard, West, Drummondville, Province of Quebec J2E 1H9, Canada

[21] Appl. No.: 383,072

[22] Filed: Jul. 21, 1989

[51] Int. Cl.[5] ..... A63B 00/00

[52] U.S. Cl. ..... 273/339; 273/338

[58] Field of Search ..... 273/338, 339, 336, 337

[56] References Cited

U.S. PATENT DOCUMENTS

| | | | |
|---|---|---|---|
| 1,617,127 | 2/1927 | Levay | 273/339 |
| 2,076,010 | 4/1937 | String | 273/338 X |
| 3,823,942 | 7/1974 | Duncan | 273/338 X |
| 4,180,266 | 12/1979 | Morin et al. | 273/338 |

FOREIGN PATENT DOCUMENTS

| | | | |
|---|---|---|---|
| 16849 | of 1897 | United Kingdom | 273/338 |

*Primary Examiner*—William H. Grieb

[57] ABSTRACT

In a game of quoits, there is provided a peg defining a central post to the upper section of which is anchored two bent rods. The post is driven into the ground. The rods each defines two upturned legs or prongs, the four prongs surrounding the central post. A quoit is to be tossed over the prongs, so as to engage at least one prong, or the central post, or one prong concurrently with the post.

16 Claims, 4 Drawing Sheets

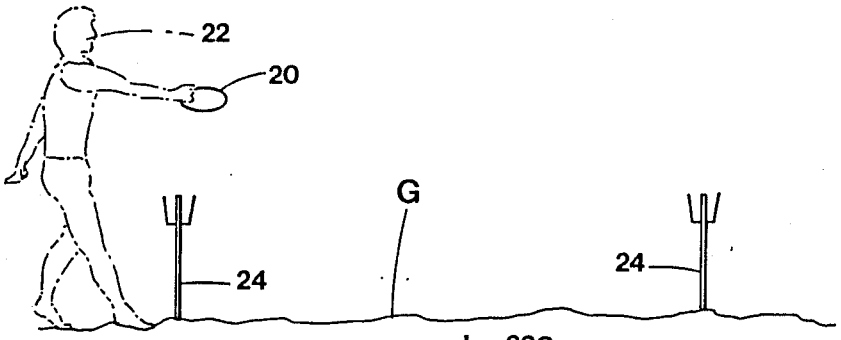
Fig 1
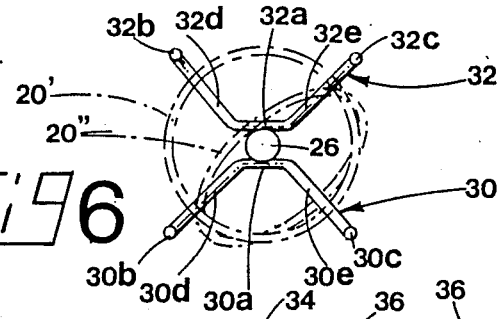
Fig 6
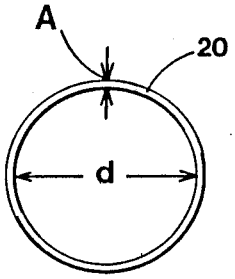
Fig 2
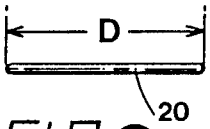
Fig 3
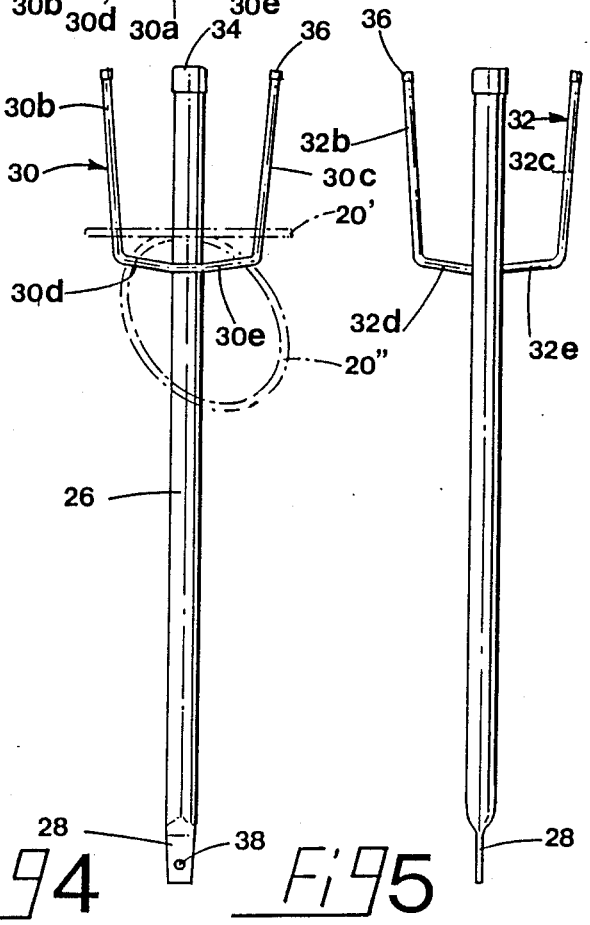
Fig 4
Fig 5

FLYING RING

FIELD OF THE INVENTION

This invention relates to the game of quoits.

BACKGROUND OF THE INVENTION

The well known game of horseshoes is a form a quoits played by tossing horseshoes over a peg, at a distance. A quoit is a flattened iron ring, to be thrown toward a fixed peg usually driven into the ground. A peg is a marker, either a pin driven into the ground or other marker means.

Little improvements over the known elements forming the quoits game have been proposed in the art. This means that the challenge may have worn off with time.

OBJECT OF THE INVENTION

The gist of the invention is to increase the challenge in the game of quoits by proposing a new type of peg marker.

SUMMARY OF THE INVENTION

In accordance with the object of the invention, there is disclosed a game of quoits in which at least one annular quoit member is to be tossed by a player at a peg member, said quoit member being lightweight, said peg member defining a fork member and support means to support said fork member at a substantially fixed position; wherein said fork member includes a central upturned prong and at least two upturned, peripheral, spaced prongs; said prongs being so spaced and said quoit being of such dimension that said quoit is engageable either about one of said prongs, or concurrently about the central prong and one peripheral prong.

Preferably, said peripheral prongs diverge upwardly slightly outwardly from axes parallel to said central prong.

Advantageously, there are four peripheral prongs in two pairs of successive prongs, the prongs of each pair consisting of the corresponding end sections of a common bent rod.

It is envisioned that said central prong be a tubular post, diametrally larger than said rods, each of said rods having an intermediate section being fixedly anchored to the tubular post on opposite sides thereof and transversely thereof.

Profitably, the free ends of said rods and of said tubular post are engaged by sockets, said sockets being made from a shock-absorbing resilient material, for dampening impact by the tossed quoit falling thereon.

Preferably, said support means includes a tubular extension of said tubular post having a bottom flattened end section driven into the ground.

Said tubular post flattened end section may preferably further include a through-bore extending transversely thereof, for through engagement by hook means for hookingly securing said peg member to a wall or the like when not in use.

Advantageously, said peg member is made from an injection-molded plastic material.

Said central prong is preferably a tubular member, diametrally larger than the peripheral prongs, said peripheral prongs defining inner edge sections relative to said central tubular member which taper upwardly outwardly thicknesswisely, whereby the upper, annular, open area of said fork member is slightly larger than the lower, annular, open area thereof, for facilitating passage of the quoit therethrough around said central prong.

With two pairs of peripheral prongs, said support means could alternately include thin elongated rigid strips, interconnecting the bottom ends of said peripheral prongs in opposite pairs and centrally merging with the bottom end of said central prong.

It is envisioned that said support means further includes ground-anchoring means, consisting of short spikes downwardly depending from the free end sections of said strips, said spikes destined to be driven into the ground.

It would be desirable that said prongs be hollow and that they open through said strips at their bottom ends.

It would also be desirable that said support means further include a flat buoyancy board and short spikes downwardly depending from the free end sections of said strips, said spikes impaling said buoyancy board for releasably anchoring the latter flatly against said thin strips.

Advantageously, said spikes are cross-sectionally X-shaped.

Profitably, said board is substantially circular in plan view and diametrally larger than the length of any one of said strips.

The top ends of said prongs are preferably substantially coplanar.

It is envisioned that said two rods form two opposite, flattened, substantially V-shape figures in top plan view.

BRIEF DESCRIPTION OF THE DRAWINGS

FIG. 1 is a schematic view showing how a player may use a first embodiment of a quoit game;

FIGS. 2 and 3 are plan and edge views respectively of a quoit used in said game;

FIGS. 4 and 5 are elevational views of a peg, at right angle of each other, as used in said game, and further showing in FIG. 4 two quoits in phantom lines being engaged into the upper prongs thereof;

FIG. 6 is a top plan view of the peg of FIG. 4, clearly showing the four-prong fork at the upper section of the peg;

DETAILED DESCRIPTION OF THE INVENTION

Figure 7:
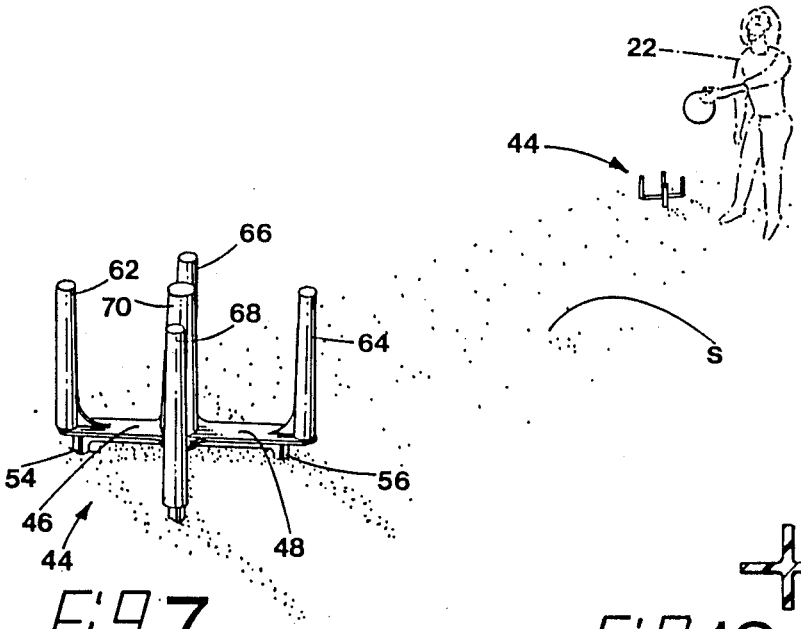
FIG. 7 is a view similar to that of FIG. 1, but for a second embodiment of a quoit game.

In the embodiment of FIGS. 1–6, the game of quoits involves a number of annular rings or "quoits", 20, to be handled and eventually thrown by a player 22 standing up on the ground G, toward an elongated peg 24 driven in upright position into the ground G. Each quoit 20 is cross sectionally circular and defines an inner diameter d, an outer diameter D, and a cross-sectional area A, wherein $D=d+2A$.

Each peg 24 comprises an elongated tubular post 26, having a flattening 28 at one (bottom) end for engagement into the ground. Two rods 30, 32 are transversely mounted at their intermediate sections 30, 32 by welding or the like means, to the opposite (upper) end of the post 26. Each rod 30, 32 is identical to each other and bent so as to form two upwardly, slightly-outwardly diverging legs or prongs **30*b*, 30*c* or 32*b*, 32*c*, at both free end sections thereof. Indeed, these prongs 30*b*, 30*c*, 32*b*, 32*c* upwardly outwardly diverge from a virtual vertical axis which is parallel to the lengthwise axis of post 26, by a common angle $\alpha$. Each rod 30, 32 is further bent about a substantially horizontal plane so as to define two rod sections 30*d*–30*e* or 32*d*–32*e*, substantially at right angle to each other, Rod sections 30*d*, 30*e* merge with rod section 30*a*, and similarly for rod sections 32*d*, 32*e* with rod section 32*a*. Rod sections 30*d*–30*e* and 32*d*–32*e* may be made to extend outwardly, very slightly upwardly, so as to define a lowermost intermediate trough corresponding to intermediate section 30*a* or 32*a***.

Hence, as illustrated in FIG. 4 or 5, each rod 30 or 32 is of U-shape in elevational view, and as shown in FIG. 6, forms a flattened V in top plan view.

Preferably, to the top ends of each rod segments 26 and **30*b*, 30*c*, 32*b*, 32*c*, there is mounted a larger socket 34 (for segment 26) and smaller socket 36 (for the others), having shock-dampening features. Preferably also, the flattened end of tube 26 has a transverse throughbore 38, wherein the peg 24 can be hung to a nail on a wall when not in use. Noteworthy, the axes of rod segments 30*d*–*e* and 32*d*–*e* do not intersect the centre of post 26, since they are slightly outwardly offset, although they do tangentially intersect the post. Also, the opposite segments 32*d*, 30*e* and 30*d*, 32*e*, are not colinear, since transversely offset as clearly seen from FIG. 6**.

An important feature of the invention is that the distance L between each pair of opposite prongs **30*b*–32*c*, or 32*b*–30*c*, be substantially larger than the outer diameter D of quoit 20, whereby the latter may easily engage about the central prong between these four prongs, flatly in substantially horizontal position as supported by base legs 30*d*–*e*, 32*d*–*e* (see quoit 20' in FIGS. 4, 6). Moreover, the relative, substantially identical distance 1 between each pair of peripherally successive prongs 30*b*–30*c*, or 30*c*–32*c*or 32*c*–32*b*, or 32*b*–30*b*, should be only slightly larger than the inner diameter d of quoit 20, whereby a quoit tossed by a player 22 would not be able to engage concurrently about two prongs of anyone of said pairs of successive prongs. Of course, a quoit could engage anyone of the peripheral prongs individually, in a single pass (see quoit 20" in FIGS. 4, 6). Finally, the center prong and a single peripheral pronq could be engaged concurrently by a quoit 20** falling thereon.

It can now be understood that the game is, for the player being at a distance from the peg standing upright on the ground, to toss one or more quoits in the air, above the level of the peg, so that the quoit be able to fall by its own weight into the prongs 30, 32 if well targeted. The pegs are driven into the ground with one pair of side prongs aligned with the other peg. Flattened end 28 prevents rotation of post 26 about its axis.

Basically, six different alternatives can therefore be envisioned:

(a) the quoit misses the target (what could usually happen);

(b) the quoit engages only a single lateral peripheral prong (more difficult);

(c) the quoit engages either one of the front and back peripheral prongs (still more difficult);

(d) the quoit engages between the four prongs **30*b*, 30*c*, 32*b*, 32*c*, around the center prong 26, so as to come to rest flatly against base legs 32*d*–32*e*, 30*d*–30*e*** (much more difficult);

(e) the quoit concurrently engages one lateral peripheral prong and the center prong (still more difficult); or (f) the quoit concurrently encircles the center prong and either one of the front and back peripheral prongs (most difficult).

One example of rules would provide that in the above-noted alternatives, zero or a negative point would be computed for alternative (a);
five points would be computed for alternative (b);
ten points would be computed for alternative (c);
twenty points would be computed for alternative (d);
twenty-five points would be computed for alternative (e);
thirty points would be computed for alternative (f).

The goal for a player could be to be the first to score exactly 105 points. It is envisioned that each player would have two quoits in a given set, and that it would be permissible to knock off from the fork member the opponent's quoit(s). Basically, two or four players are preferred during a game. The pegs could be driven into the ground from four to six meters from the throw line.

Of course, other rules could apply, provided there is some reaction that within the scope of the game of skill, said four alternatives are of a different level of difficulty and should be rewarded accordingly if achieved by the player.

Figure 13:
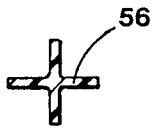
FIG. 13, on the second sheet of drawings, is a cross-sectional view taken along line 13—13 of FIG. 12.
Figure 11:
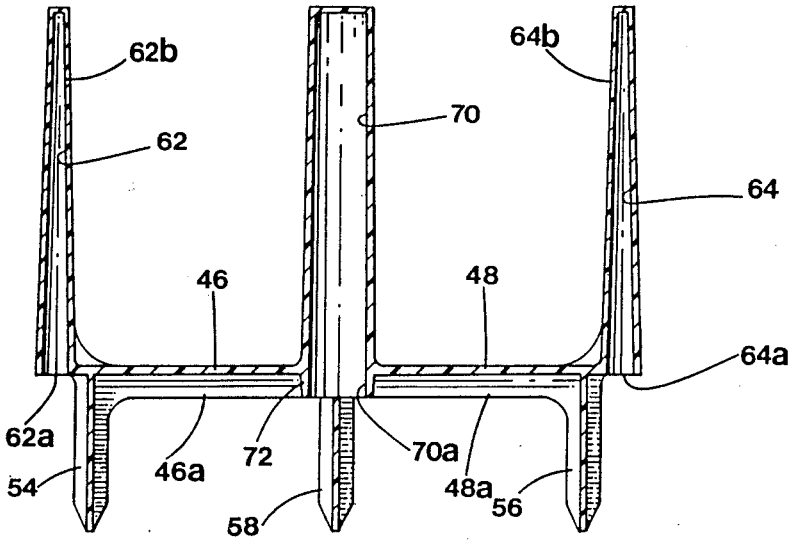
FIG. 11, on the second sheet of drawings, is a sectional view taken along line 11—11 of FIG. 10.
Figure 8:
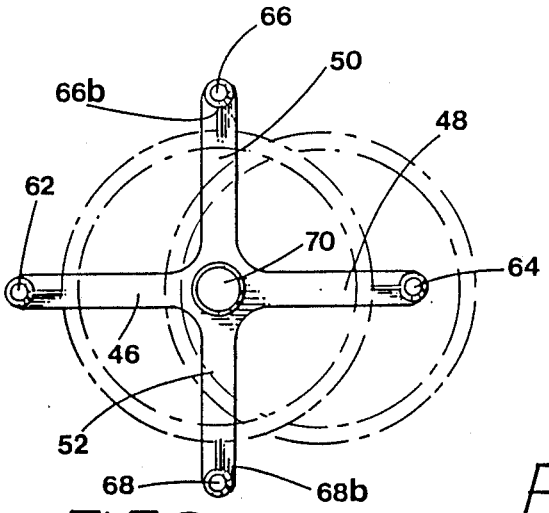
FIG. 8, on the third sheet of drawings, is an enlarged top plan view of the four prong fork of one peg from FIG. 7, showing two quoits in phantom lines being mounted thereon.
Figure 9:
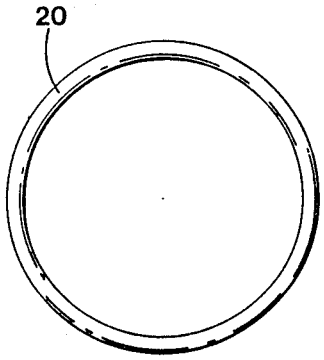
FIG. 9 is a plan view of a quoit in FIG. 7.
Figure 12:
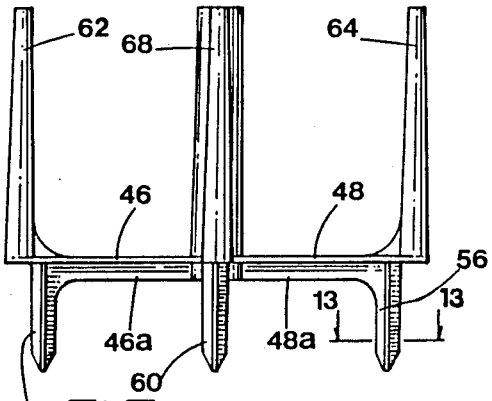
FIG. 12, on the third sheet of drawings, is a side elevational view of the latter embodiment peg.
Figure 10:
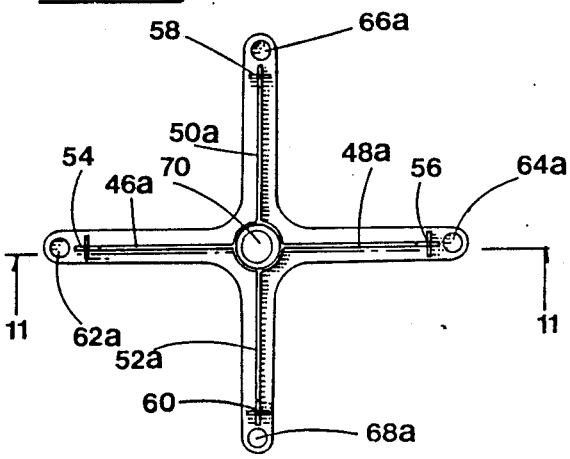
FIG. 10 is a bottom plan view of the latter peg fork.
Figure 14:
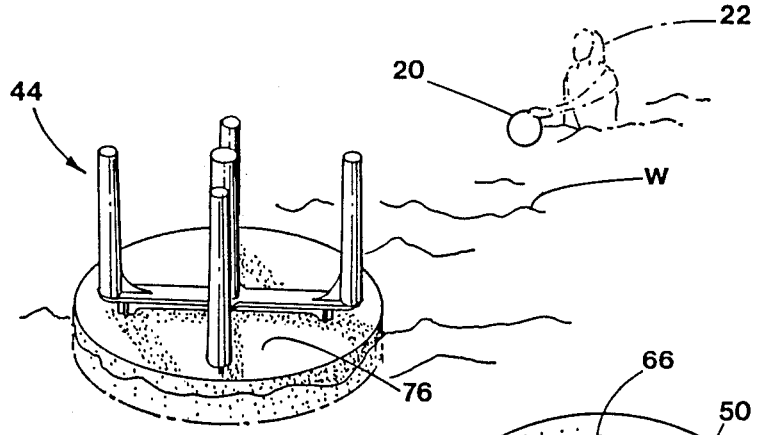
FIG. 14, on the fourth sheet of drawings, is a view similar to FIGS. 1 or 7, but for a third embodiment of game, used in the water.
Figure 16:
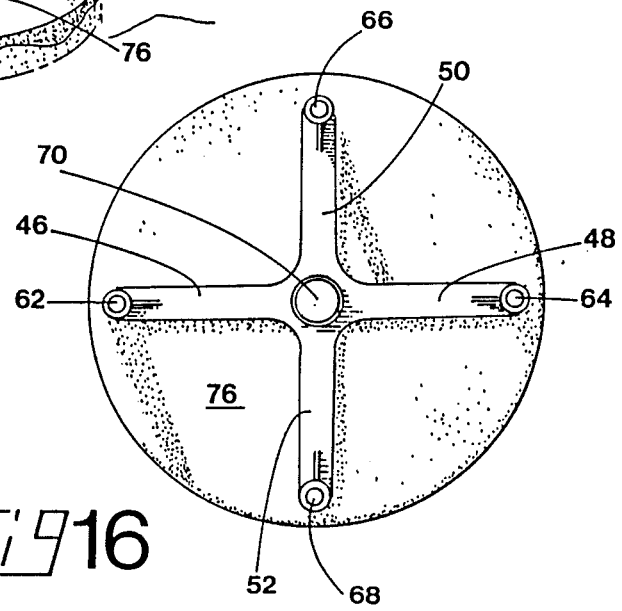
FIGS. 15–16 are elevational and top plan views respectively of a float peg member used in the game thereof.
Figure 15:
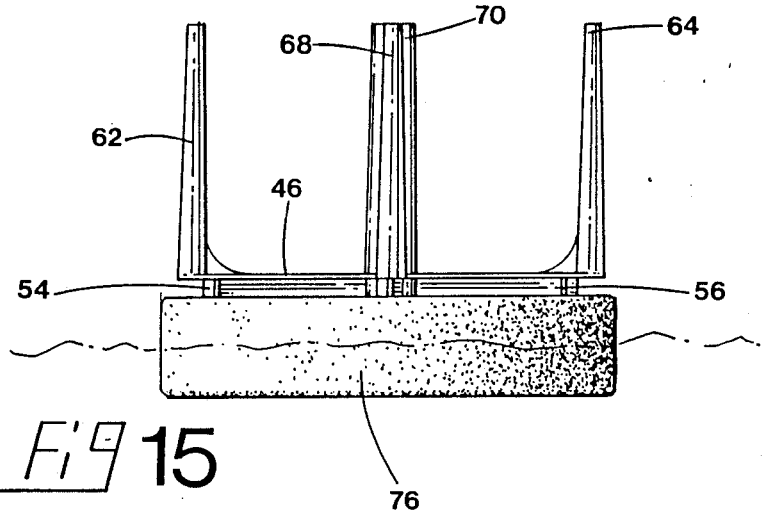

In the second embodiment of the invention, shown in FIGS. 7–13, the peg 44 is made from a plastic material, e.g. by injection molding, and includes four flat, thin base legs 46, 48, 50, 52 at right angle of each other, so as to form a "+". The underface of each leg 46–52 includes a ridge **46*a*–52*a* interconnecting four transverse spikes 54–60, one at each end of the legs 46–52 respectively. Spikes 54–60 are cross-sectionally X-shaped and destined to be drivingly engaged into the ground. From the top face of legs 46–52, i.e. opposite spikes 54–60, upwardly project five tubular hollow prongs: four corner prongs 62, 64, 66, 68 one at each end of legs 46–52 respectively, and a fifth diametrally larger central prong 70, projecting from the merging section of legs 46–52. Hollow prongs 62–70 may be open at their bottom ends 62*a*–70*a*, with aperture 70*a* extending through a central downturned skirt 72**.

Advantageously, the inner wall section **62*b*–68*b* of corner prongs 62–68 is diverging slightly outwardly from an axis perpendicular to the plane of legs 46–52, whereby the upper annular area defined between the innermost tangential edge of corner prongs 62–68 and the outer wall of the central prong 70 is slightly larger than the corresponding area adjacent to legs 46–52**. Such construction will facilitate engagement of the quoit between the four corner prongs around the central prong.

In the second embodiment, the ground-anchoring spikes are short relative to the quoit engaging prongs, contrarily to that in the first embodiment. Indeed, the spikes 54–60 would be most useful on a hard surface or in granular-type looser ground, such as sand S on a seafront beach, whereas the posts 26 are rather useful in earth-type firmer ground which may furthermore have some marked variations of ground level.

In the third embodiment of the invention, the player 22 plays in the water W, for instance, while standing in shallow water, and tosses the quoit 20 toward a float peg 74. Float peg may be identical to the second embodiment peg 44, but for a foam board 76 impaled into the four spikes 54–60. The board 76 is preferably circular in plan view, with flat top and bottom walls, and of sufficient buoyancy to maintain at least the prongs 62–70 above water level.

The float peg is preferably anchored by a conventional anchor (not shown).

I claim:

1. A game of quoits in which at least one annular quoit member is to be tossed by a player at a peg member, said quoit member being lightweight, said peg member defining a fork member and support means to support said fork member at a substantially fixed position; wherein said fork member includes a central upturned prong and at least four upturned, peripheral, spaced prongs in pairs of successive prongs, the prongs of each pair consisting of the corresponding end sections of a common bent rod; said prongs being so spaced and said quoit being of such dimension that said quoit is engageable either about one of said prongs, or concurrently about the central prong and one peripheral prong.

2. A game of quoits as defined in claim 1, wherein said peripheral prongs diverge upwardly slightly outwardly from axes parallel to said central prong.

3. A game of quoits as defined in claim 1, wherein said central prong is a tubular post, diametrally larger than said rods, each of said rods having an intermediate section being fixedly anchored to the tubular post on opposite sides thereof and transversely thereof.

4. A game of quoits as defined in claim 3, wherein the free ends of said rods and of said tubular post are engaged by sockets, said sockets being made from a shock-absorbing resilient material, for dampening impact by the tossed quoit falling thereon.

5. A game of quoits as defined in claim 3, wherein said support means includes a tubular extension of said tubular post having a bottom flattened end section adapted to be driven into the ground.

6. A game of quoits as defined in claim 5, wherein said tubular post flattened end section further includes a through-bore extending transversely thereof, for through engagement by hook means for hookingly securing said peg member to a wall or the like when not in use.

7. A game of quoits as defined in claim 1, wherein the top ends of said prongs are substantially coplanar.

8. A game of quoits as defined in claim 1, wherein said two rods form two opposite, flattened, substantially V-shape figures in top plan view.

9. A game of quoits in which at least one annular quoit member is to be tossed by a player at a peg member, said quoit member being lightweight, said peg member defining a fork member and support means to support said fork member at a substantially fixed position; wherein said fork member includes a central upturned prong and at least two upturned, peripheral, spaced prongs; said prongs being so spaced and said quoit being of such dimension that said quoit is engageable either about one of said prongs, or concurrently about the central prong and one peripheral prong; wherein said peg member is made from an injection-molded plastic material; and wherein said central prong is a tubular member, diametrically larger than the peripheral prongs, said peripheral prongs defining inner edge sections relative to said central tubular member which taper upwardly outwardly thicknesswisely, whereby the upper, annular, open area of said fork member is slightly larger than the lower, annular, open area thereof, for facilitating passage of the quoit therethrough around said central prong.

10. A game of quoits in which at least one annular quoit member is to be tossed by a player at a peg member, said quoit member being lightweight, said peg member defining a fork member and support means to support said fork member at a substantially-fixed position; wherein said fork member includes a central upturned prong and at least two upturned, peripheral, spaced prongs; said prongs being so spaced and said quoit being of such dimension that said quoit is engageable either about one of said prongs, or concurrently about the central prong and one peripheral prong; wherein said peg member is made from an injection-molded plastic material; and wherein there are two pairs of peripheral prongs; said support means including thin elongated rigid strips, interconnecting the bottom ends of said peripheral prongs in opposite pairs and centrally merging with the bottom end of said central prong.

11. A game of quoits as defined in claim 10, said support means further including ground-anchoring means, consisting of short spikes downwardly depending from the free end sections of said strips, said spikes destined to be driven into the ground.

12. A game of quoits as defined in claim 11, wherein said spikes are cross-sectionally X-shaped.

13. A game of quoits as defined in claim 10, wherein said prongs are hollow and open through said strips at their bottom ends.

14. A game of quoits as defined in claim 10, said support means further including a flat buoyancy board and short spikes downwardly depending from the free end sections of said strips, said spikes impaling said buoyancy board for releasably anchoring the latter flatly against said thin strips.

15. A game of quoits as defined in claim 14, wherein said spikes are cross-sectionally X-shaped.

16. A game of quoits as defined in claim 14, wherein said board is substantially circular in plan view and diametrally larger than the length of any one of said strips.

* * * * *